US005853156A

United States Patent [19]

Moore et al.

[11] Patent Number: 5,853,156

[45] Date of Patent: Dec. 29, 1998

[54] RAIL CLAMP

[75] Inventors: Anthony D. Moore, Winston-Salem; William C. Overman, Reidsville, both of N.C.

[73] Assignee: CAMCO Manufacturing, Inc., Greensboro, N.C.

[21] Appl. No.: 644,109

[22] Filed: May 10, 1996

[51] Int. Cl.[6] ..... E06C 7/14

[52] U.S. Cl. ..... 248/210; 248/238; 248/316.5; 248/231.51; 224/545; 182/127; 211/124

[58] Field of Search ..... 248/210, 238, 248/211, 316.51, 316.5, 309.1, 231.51, 229.13, 229.23, 228.4, 230.4, 214, 221.12, 222.41, 552, 222.11; 211/124, 193, 207, 107; 224/42.52 R, 42.02 B, 42.03 R, 42.07, 42.08; 24/569; 182/127

[56] References Cited

U.S. PATENT DOCUMENTS

| | | | |
|---|---|---|---|
| 2,222,289 | 11/1940 | Fordon | 24/569 |
| 2,581,782 | 1/1952 | Anderson | 328/63 |
| 2,759,695 | 8/1956 | Berner | 248/95 |
| 3,081,056 | 3/1963 | Young et al. | 248/552 |
| 3,476,342 | 11/1969 | Moi et al. . | |
| 3,848,838 | 11/1974 | Thomas | 248/42 |
| 3,877,622 | 4/1975 | Mclain | 224/42 |
| 3,904,161 | 9/1975 | Scott | 248/43 |
| 3,986,746 | 10/1976 | Chartier | 24/569 |
| 4,027,798 | 6/1977 | Swaim | 248/552 |
| 4,078,708 | 3/1978 | Mayer | 224/29 |
| 4,108,413 | 8/1978 | Goserud | 24/569 |
| 4,290,529 | 9/1981 | Jones et al. | 211/13 |
| 4,297,069 | 10/1981 | Worthington | 414/462 |
| 4,561,154 | 12/1985 | Briscoe et al. | 24/115 |
| 4,676,413 | 6/1987 | Began et al. | 224/42 |
| 4,852,840 | 8/1989 | Marks | 248/230.4 |
| 4,865,169 | 9/1989 | Rachels et al. | 24/569 |
| 4,909,463 | 3/1990 | Zvanut et al. | 248/219 |
| 4,967,942 | 11/1990 | McGruder | 224/42 |
| 5,305,978 | 4/1994 | Current | 248/230 |
| 5,354,030 | 10/1994 | Harwood | 248/316 |
| 5,372,287 | 12/1994 | Deguevara | 224/42 |
| 5,474,270 | 12/1995 | Rixen et al. | 248/221.11 |
| 5,478,041 | 12/1995 | Mayne | 248/231.51 |
| 5,584,818 | 12/1996 | Morrison | 604/197 |
| 5,622,345 | 4/1997 | Hopkins | 248/230.5 |

FOREIGN PATENT DOCUMENTS

| | | | |
|---|---|---|---|
| 012819 | 3/1956 | Germany | 24/569 |

*Primary Examiner*—Ramon O. Ramirez
*Assistant Examiner*—Kimberly Wood

[57] ABSTRACT

A rail clamp is provided for attachment to a vertical rail such as a side rail of a ladder as are used on the rear of recreational vehicles. The rail clamp is molded from plastic and includes threaded members with knobs which allow the clamp to be tightened in any of a variety of positions along the rail. A pair of rail clamps are generally used for carrying bulky items such as lawn chairs exteriorly of the RV. The rail clamps are molded from durable plastic and will fit different size ladder rails as required. The knobs, threaded members and securing nuts can be reversed for convenience in use to either the right or left sides of the clamp body portion.

3 Claims, 6 Drawing Sheets

RAIL CLAMP

BACKGROUND OF THE INVENTION

1. Field of the Invention

The invention herein pertains to clamping devices which are used to support lawn chairs or other items adjacent, for example, an RV (recreational vehicle) ladder. The clamp includes a pivotable jaw which can be latched and locked in a closed position to prevent theft of the contained items. A pair of rail clamps are generally used, one on each vertical ladder rail to hold chairs exteriorly of the RV.

2. Description of the Prior Art and Objectives of the Invention

Various types of rail clamps have been used in the past for carrying lawn chairs and other items, as shown in U.S. Pat. No. 5,622,345 issued 22 Apr. 1997, which is a continuation of application Ser. No. 260,263, filed 14 Jun. 1994. This device requires a pair of mirror image clamps, one for attachment to each ladder rail.

U.S. Pat. No. 4,078,708 provides a rack for transporting skis on the rear of a vehicle. U.S. Pat. No. 3,904,161 provides a clamp for attaching an umbrella. U.S. Pat. No. 4,297,069 provides a chair carrier for Attachment of a wheelchair to the rear of a vehicle.

Although the prior art devices listed above have been available, there has existed a need for a clamp for attachment to a ladder rail for RV's and other vehicles which is durable, lightweight and more versatile than existing clamps. Accordingly, the present invention was conceived and one of its objectives is to provide a rail clamp which can be used on either the right or left ladder rail by simply changing the position of the threaded members in the clamp body, which are used to tighten the clamp in place.

It is another objective of the present invention to provide a rail clamp which is relatively inexpensive and is simple to operate.

It is yet another objective of the present invention to provide a rail clamp which can be locked with a standard padlock if desired.

It is still another objective of the present invention to provide a rail clamp which allows the user to rotate the clamp around the rail in any of a variety of positions as needed.

Various other objectives and advantages of the present invention will become apparent to those skilled in the art as a more detailed description is set forth below.

SUMMARY OF THE INVENTION

A vertical rail clamp is provided which is molded from conventional plastic for use in pairs, for example, for attachment to the vertical rails of a rear RV ladder. The clamps allow the user to carry lawn chairs or other items in a safe, secure exterior position on the RV. Locking tabs on the clamps accommodate padlocks for securing the items held thereby. The rail clamps each include a body portion with an upper and lower jaw affixed thereto with the upper jaw being pivotable. The body portion, which is somewhat flexible, includes a vertical passage which is keyhole-shaped and is tightenable by threaded members having knobs thereon. The threaded members can be reversed so the knobs will be placed on the opposite side of the body portion for convenience in use when the rail clamps are affixed, for example, to the vertical rails of an RV ladder. The upper and lower jaws each include a locking tab a padlock as needed and a spring-loaded latch at the distal end of the jaws maintains the upper and lower jaws together.

DETAILED DESCRIPTION OF THE PREFERRED EMBODIMENT OF THE INVENTION

Figure 1A:
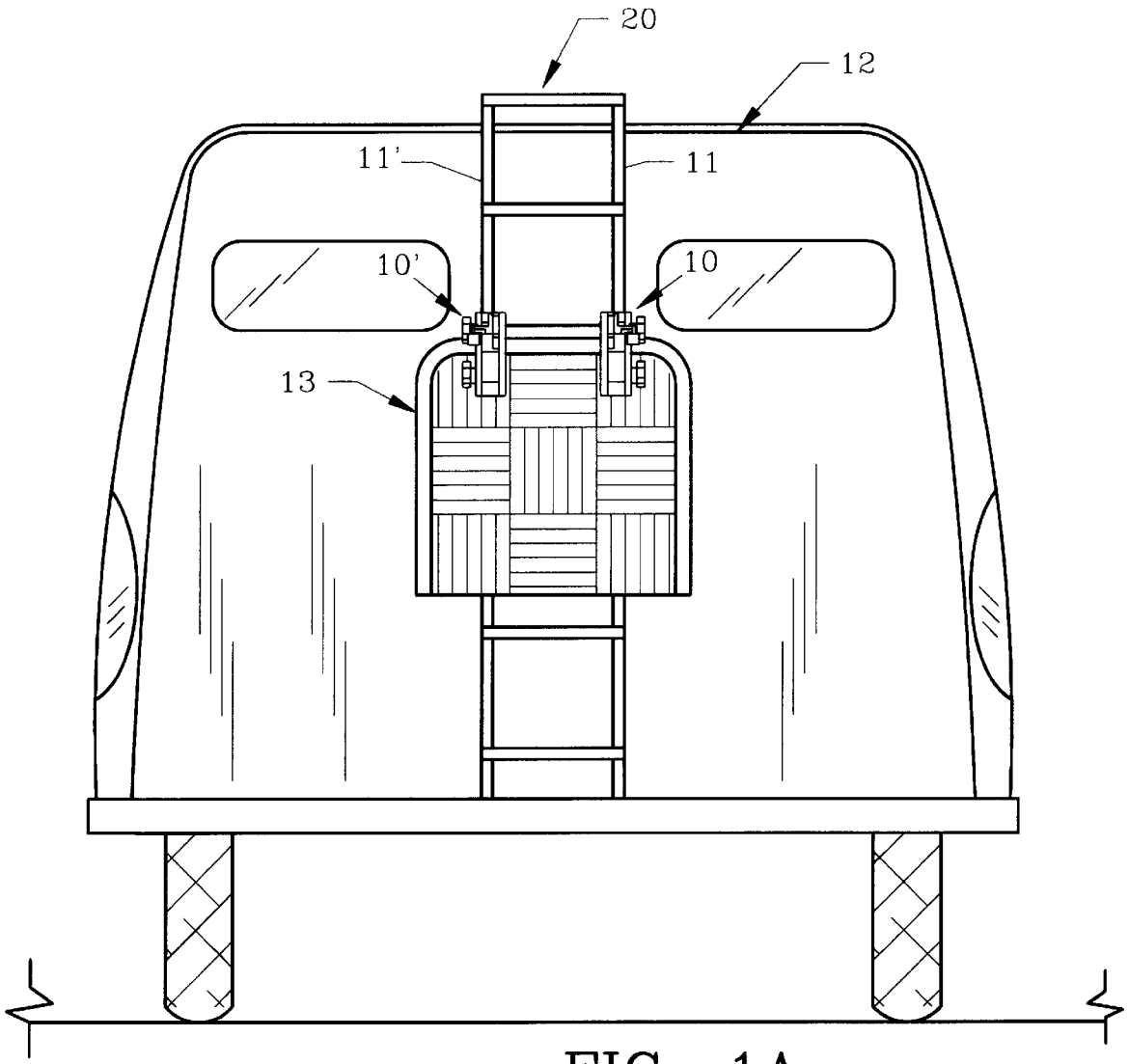
FIG. 1A illustrates a typical rear view of an RV with the rail clamps of the invention affixed to the ladder thereon.
Figure 2:
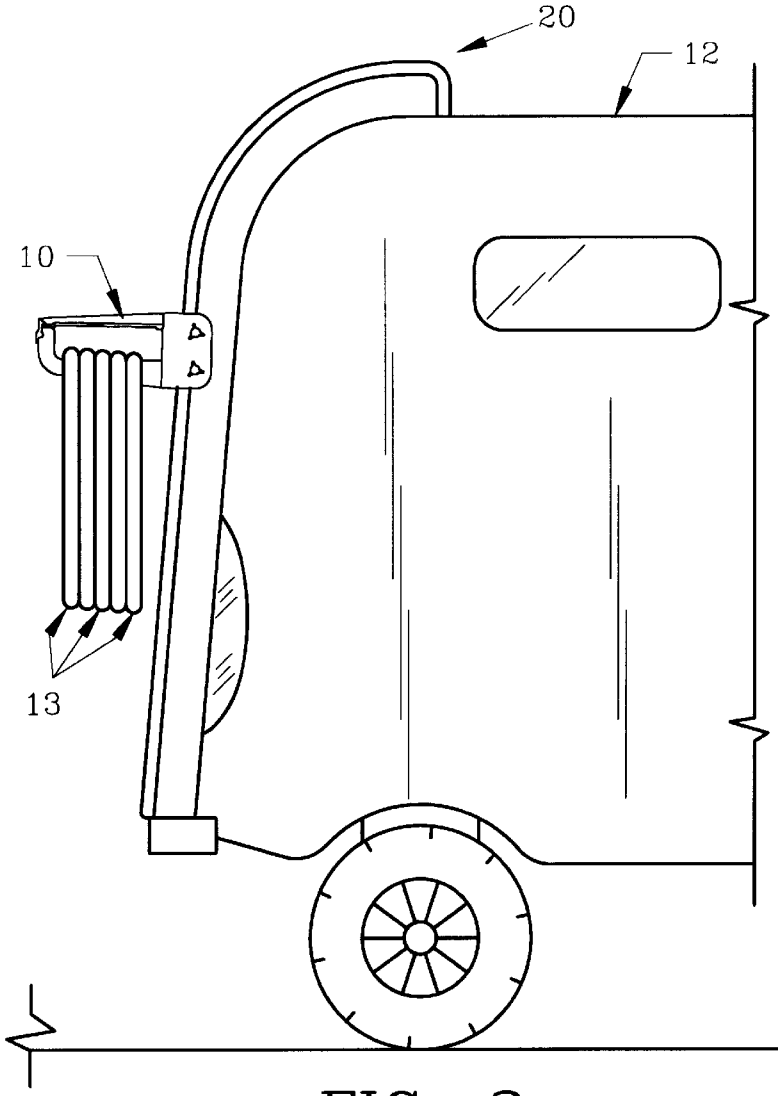
FIG. 2 presents a side elevational view of the rear of the RV as shown in FIG. 1A to illustrate the rail clamps as attached.

For a better understanding of the invention, turning now to the drawings, FIG. 1A illustrates a pair of preferred rail clamps 10, 10' attached to vertical rails 11, 11' of conventional ladder 20 affixed to the rear of RV 12. Rail clamps 10, 10' are used for holding folding chairs 13, as also shown in FIG. 2, exteriorly of RV 12 to provide additional storage of items, usually not needed during transportation. Rail clamps 10 and 10' are identical, except rail clamp 10' has threaded members 16, 16' and knobs 15, 15' reversed or on opposite sides. (See FIGS. 4 and 6).

Figure 1C:
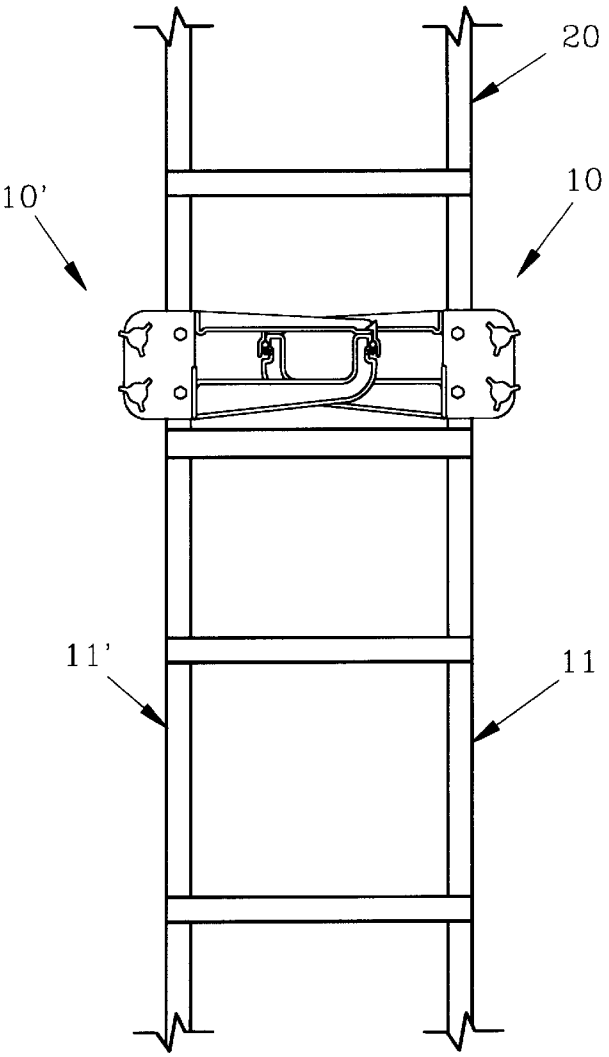
FIG. 1C features the RV ladder of FIG. 1B but with the rail clamps rotated inwardly.
Figure 1B:
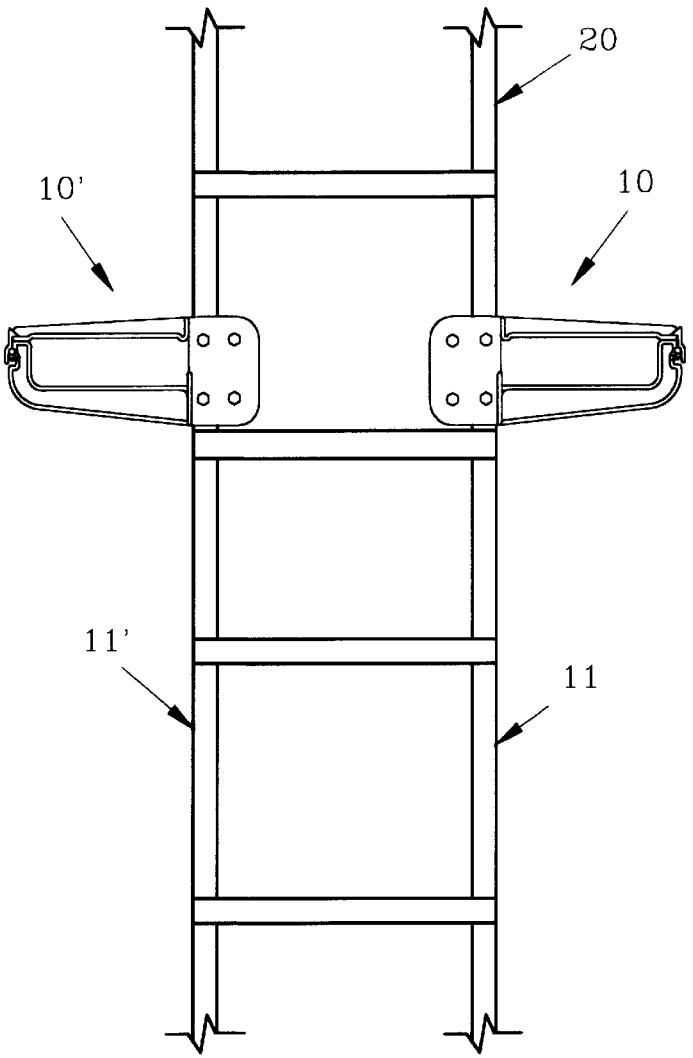
FIG. 1B shows the RV ladder of FIG. 1 fragmented and removed with the rail clamps rotated to an outward posture.

FIGS. 1B and 1C illustrate rail clamps 10, 10' on typical RV or van ladders which have been fragmented and removed from the vehicles for clarity purposes. As seen in FIG. 1B, rail clamps 10, 10' have been rotated outwardly as may occur when the chairs or other items are removed and it is desired to climb ladder 20. In FIG. 1C, rail clamps 10, 10' have been rotated inwardly as may be useful when the RV or van is being driven along the highway with clamps 10, 10' not containing chairs or other items.

Figure 3:
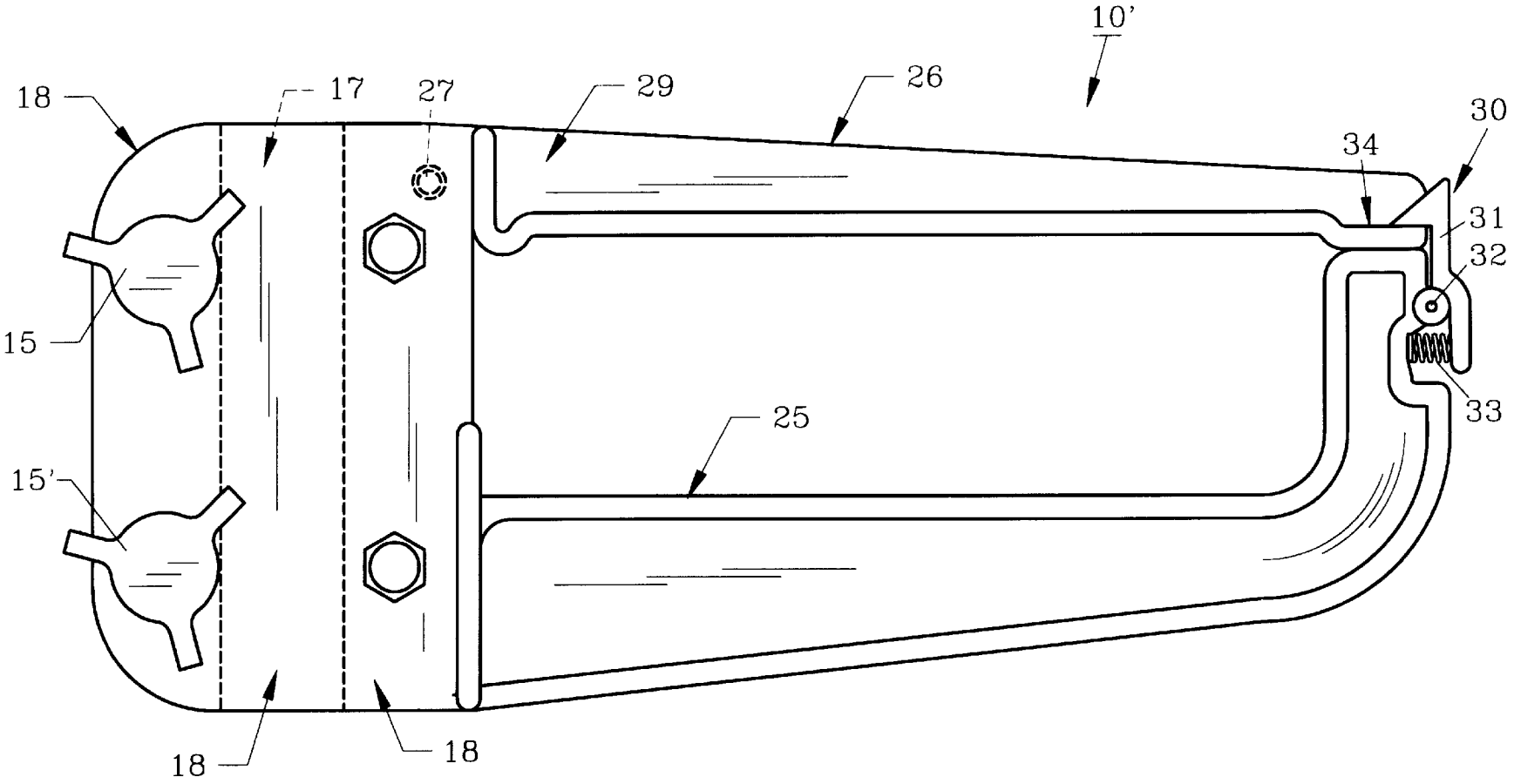
FIG. 3 pictures a side elevational view of the rail clamp in a closed posture.

Rail clamp 10 as seen in FIG. 3 is versatile in that it can be placed on vertical ladder rails having different diameters and by tightening knobs 15, 15' which are positioned on threaded members 16, 16' (15', 16' not seen in FIG. 4) the diameter of key-shaped passageway 17 is reduced to thereby maintain rail clamp 10 in a tightened, fixed position. As would be understood, vertical passage 17 as defined in body portion 18 of clamp 10, is adjustable in size since body portion 18 is formed from plastic and will flex to a limited degree by tightening knobs 15, 15'. Thus, knobs 15, 15' threaded members 16, 16' and nuts 19, 19' provide means for flexing body portion 19.

Figure 4:
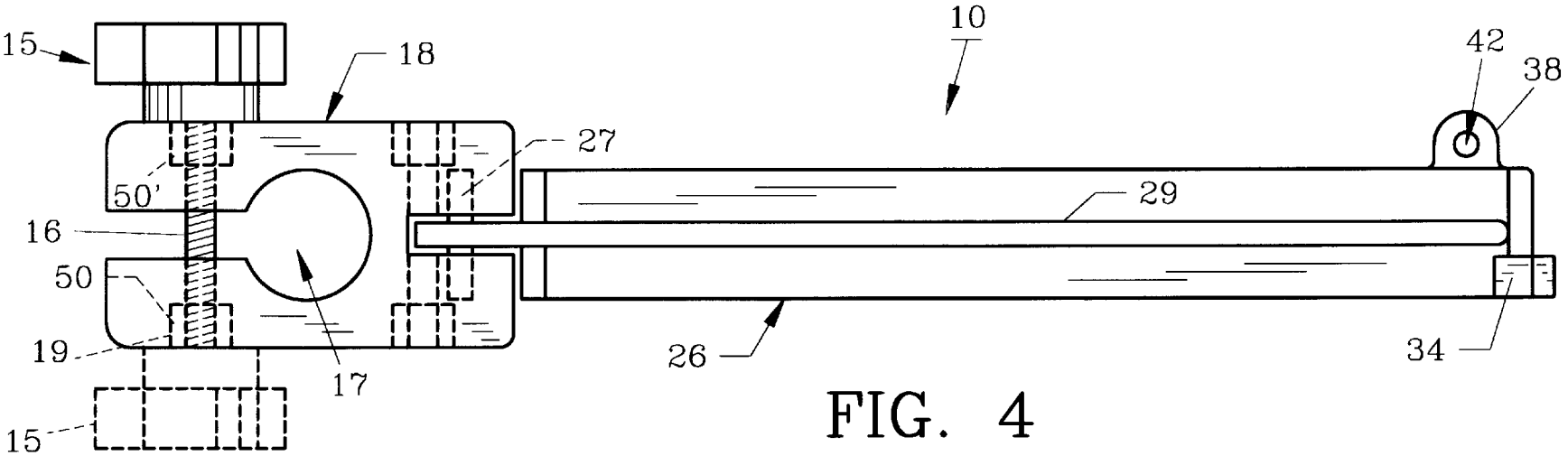
FIG. 4 depicts a top view of the rail clamp of FIG. 3 including the optional positioning of the tightening knob.
Figure 6:
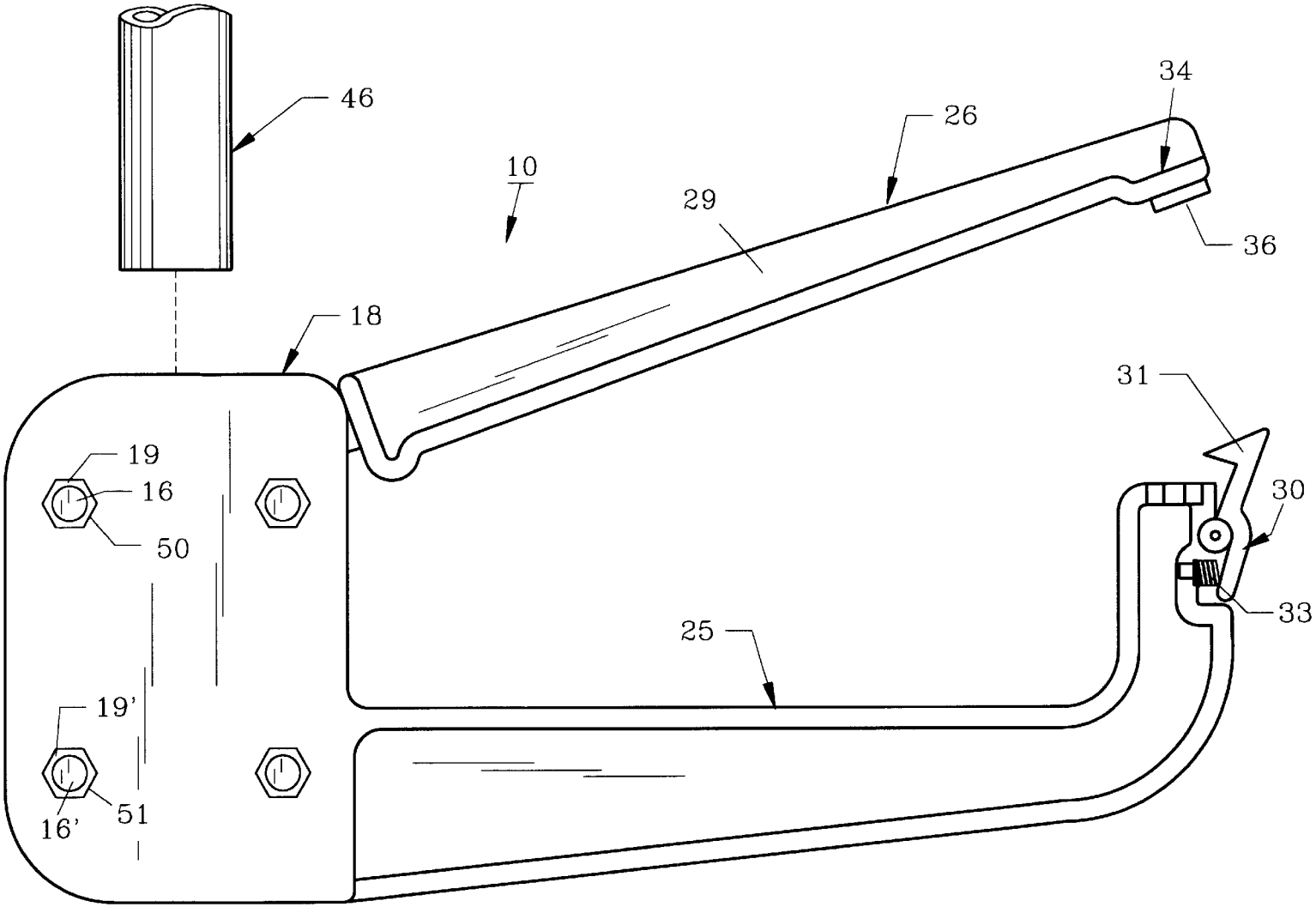
FIG. 6 demonstrates a side view of the rail clamp with an auxiliary sleeve for use therewith.

Rail clamp 10 is versatile and can be used on either the right rail 11 or the left rail 11' (shown as rail clamp 10') while maintaining the knobs 15, 15' to the outside of the ladder 20. Knob 15 and threaded member 16 can be reversed from side-to-side as shown in FIG. 4, to maintain knobs 15, 15' exterior of ladder 20 for easy usage. Nuts 19, 19' would also, of course, be reversed to the opposite side of body portion 19 to allow threaded member 16 to tighten therein as shown in FIG. 6.

Lower jaw member 25 is rigidly attached to body portion 18 whereas upper jaw 26 is pivotally attached through axle 27, as shown in FIGS. 3 and 4. Upper jaw 26 is shown slightly pivoted in FIG. 6 to allow chair frames or the like to be positioned between jaws 25, 26. To strengthen upper jaw 26, a longitudinal rib 29 is formed therewith, as shown in FIGS. 3 and 4. Rib 29 may be integrally formed during the molding process as rail clamp 10 is preferably formed from a conventional moldable plastic.

Figure 5:
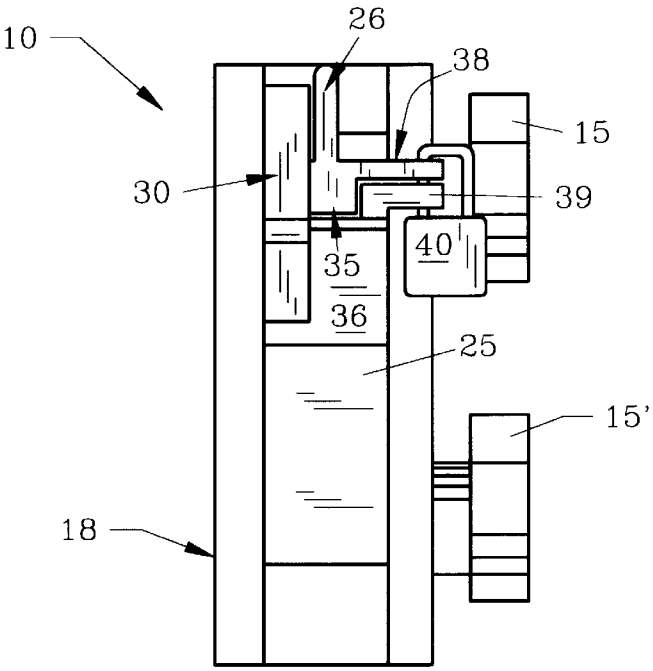
FIG. 5 illustrates a front view of the rail clamp showing the padlock used therewith.

In order to secure upper jaw 26 to lower jaw 25 as shown in FIG. 3, latch assembly 30 is provided. Latch assembly 30 includes pivot axle 32, which is affixed to lower jaw 25 and resilient coil spring member 33. Resilient member 33 provides biasing to latch assembly 30 to maintain latch 31 closed against shelf 34 of upper jaw 26. To insure correct alignment, upper jaw 26 includes a longitudinal projection 36 as seen in FIGS. 5 and 6. Projection 36 engages alignment recess 35 on lower jaw 25 as seen in FIG. 5. Sleeve 46 is also shown in FIG. 6 which is formed from a vinyl or other flexible material. Sleeve 46 is used with clamp 10, for example, when a vertical ladder rail is substantially smaller than vertical passage 17 to act as a filler. The length of sleeve 46 approximates the length of vertical passage 17 within body portion 18 of rail clamp 10.

To prevent theft or unwanted removal of chairs 13 or other items secured by rail clamps 10, 10', padlock 40 can be used to secure locking tab 38 which is attached to upper jaw 26 and to locking tab 39 affixed to lower jaw 25. As shown in FIG. 4, locking tab 38 includes opening 42 for reception of padlock 40, while locking tab 39 also provides coincidental a opening (not seen).

The illustrations and examples provided herein are for explanatory purposes and are not intended to limit the scope of the appended claims.

We claim:

1. A vertical rail clamp comprising:

a flexible body section;

a lower jaw, said lower jaw attached to said body section, said lower jaw comprising a first lock tab, said lower jaw defining a horizontally extending alignment recess;

an upper jaw, one of said jaws pivotally joined to said body section, said upper jaw comprising a longitudinal rib and a second lock tab;

said body section defining a keyhole shaped vertical passage, means for reducing the dimensions of said vertical passage, said reducing means comprising;

an elongated threaded member, said elongated threaded member positioned perpendicularly to said body section;

a jaw latch, said jaw latch for securing said upper jaw and said lower jaw in a closed posture, said jaw latch affixed to one of said jaws;

a knob with an external diameter, said knob positioned on one end of said threaded member; and a fastener, said fastener with an external diameter smaller than the external diameter of said knob, said fastener positioned on the other end of said threaded member, said knob and said fastener positioned on opposite sides of said body section;

said body section further defining a pair of oppositely positioned recesses, said recesses for selectively receiving said fastener to prevent said fastener from rotating whereby tightening said knob directs said threaded member into said fastener and reduces the diameter of said vertical passage by flexing said body section and whereby said recesses hold said fastener thereby allowing a user to reduce the diameter of said vertical passage with one hand by tightening said knob.

2. A vertical rail clamp for attachment to a ladder rail comprising:

a body flexible section, said body section defining a vertical passage, said vertical passage for receiving a ladder rail, said body section formed of semi-rigid plastic, a pair of means for reducing said vertical passage, each of said passage reducing means affixed to said body section, a lower jaw, said lower jaw affixed to said body section and further comprising a first lock tab, an upper jaw, said upper jaw further comprising a longitudinal rib and a second lock tab, said upper jaw pivotally joined to said body section whereby said upper jaw will pivot into contact with said lower jaw for holding articles therewithin, said second lock tab coincidental to said first lock tab when said upper jaw contacts said lower jaw, and a jaw latch assembly, said jaw latch assembly affixed to said lower jaw and comprising an axle, said axle attached to said lower jaw, a latch, said latch attached to said axle, and a spring, said spring connected to said lower jaw to bias said latch assembly.

3. A clamp for attachment to an elongated member, said clamp comprising:

a) a body portion, said body portion defining a vertical passage for receiving the elongated member, said body portion being flexible to control the dimensions of said vertical passage;

b) a lower jaw affixed to said body portion;

c) an upper jaw pivotally attached to said body portion;

d) means for flexing said body portion comprising an elongated member, said elongated member joined to said body portion to control the dimensions of the vertical passage, e) a jaw latch assembly, said jaw latch assembly comprising:

I) an axle attached to said lower jaw;

ii) a latch attached to said axle; and iii) a spring connected to said lower jaw to bias said latch assembly;

f) a knob, said knob positioned on said elongated member; and g) a nut, said nut positioned on said elongated member; wherein said elongated member is threaded, and further comprising a sleeve, said sleeve removably positioned in said vertical passage.

* * * * *